US006918585B2

(12) United States Patent
Ahn

(10) Patent No.: US 6,918,585 B2
(45) Date of Patent: Jul. 19, 2005

(54) PAPER CONVEYANCE GUIDING APPARATUS FOR DUPLEX PRINTER

(75) Inventor: Byung-sun Ahn, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 188 days.

(21) Appl. No.: 10/301,636

(22) Filed: Nov. 22, 2002

(65) Prior Publication Data

US 2003/0197325 A1 Oct. 23, 2003

(30) Foreign Application Priority Data

Apr. 19, 2002 (KR) ..... 2002-21511

(51) Int. Cl.[7] ..... B65H 29/22
(52) U.S. Cl. ..... 271/186; 399/364
(58) Field of Search ..... 271/301, 65, 186; 399/75, 105, 361, 364, 388

(56) References Cited

U.S. PATENT DOCUMENTS 5,201,517 A * 4/1993 Stemmle ..... 271/291
5,513,840 A * 5/1996 Fujita et al. ..... 271/301
6,304,742 B1 * 10/2001 Nunes et al. ..... 399/361

FOREIGN PATENT DOCUMENTS

EP 0.579.837 A1 * 1/1994 ..... B65H/29/58
JP 10-36014 2/1998

* cited by examiner

*Primary Examiner*—Donald P. Walsh
*Assistant Examiner*—Mark J. Beauchaine
(74) *Attorney, Agent, or Firm*—Staas & Halsey LLP

(57) ABSTRACT

A paper conveyance guiding apparatus of a duplex printer has an entrance passage disposed at one side of a printing unit to form a predetermined image on a paper and guide the paper to enter into the printing unit, a discharge and reverse passage formed to connect an outlet of the printing unit to an outside of a printer body and guide discharging of the paper and reversing of the paper to an inlet of the printing unit, an intermediate passage formed to connect the discharge and reverse passage to the entrance passage and guide the reversed paper to reenter into the printing unit through the entrance passage, and a reversible rotation roller disposed at a branching point of the discharge and reverse passage and the intermediate passage and discharge the paper coming out from the outlet of the printing unit by rotating forwardly and push the paper to the intermediate passage by rotating backwardly.

22 Claims, 8 Drawing Sheets

PAPER CONVEYANCE GUIDING APPARATUS FOR DUPLEX PRINTER

CROSS-REFERENCE TO RELATED APPLICATIONS

This application claims the benefit of Korean Patent Application No. 2002-21511, filed Apr. 19, 2002, in the Korean Industrial Property Office, the disclosure of which is incorporated herein by reference.

BACKGROUND OF THE INVENTION

1. Field of the Invention

The present invention relates to an apparatus for guiding conveyance of a sheet of paper in a duplex printer, which guides and reverses the paper in the duplex printer for duplex printing, and more particularly, to a paper conveyance guiding apparatus having a shortened paper reverse passage and a reversible rotation roller in a duplex printer.

2. Description of the Related Art

Generally, a printing apparatus, such as a printer or a photocopying machine, feeds a sheet of paper, prints a desired image on a first side of the paper, and discharges the printed paper to an outside of the printing apparatus. Therefore, as the image is printed on only the first side of the paper when the paper is fed once, a user has to manually reverse the paper having the printed first side to print another image on a second side of the paper. To avoid the above troubles, a duplex printer, which prints the images on respective ones of both first and second sides of the paper with one time feed and discharges the printed paper, has been introduced. FIG. 1 is a view showing one example of the duplex printer.

As shown in FIG. 1, the duplex printer has a paper conveyance guiding apparatus disposed at a printing unit 10 to perform a printing job in order to reverse a sheet of paper having the first side and the second side and pass therethrough.

Referring to FIG. 1, the paper conveyance guiding apparatus of the general duplex printer has an entrance passage 20 disposed on a way to the printing unit 10 in order to allow the paper to enter the printing unit 10, a discharge passage 30 disposed on a way out of the printing unit 10 in order to guide and discharge the printed paper to an outside of a printing body 1, a reverse passage 40 branched off from the discharge passage 30 to reverse the paper to the way to the printing unit 10, and an intermediate passage 50 to connect the reverse passage 40 and the entrance passage 20.

The printing unit 10 includes a paper conveying passage 11, a developing unit 12 disposed in a regular interval on the paper conveying passage 11, and a settlement unit 13.

The entrance passage 20 has a feed roller 21 and a register roller 22 to convey the paper entered into the entrance passage 20 after being picked up by a pick-up roller 3 from a feed cassette 2. In addition, a first discharging roller 14 is disposed at the way out of the printing unit 10 in order to convey the printed paper in a discharging direction, and a discharging sensor 15 disposed near the first discharging roller 14 to sense the paper passing through the printing unit 10. The discharging sensor 15 sends a sensing signal of sensing the paper passing through the printing unit 10 to a controller (not shown). Furthermore, a second discharging roller 31 and a third discharging roller 32 are disposed at the discharge passage 30. In FIG. 1, reference numerals 33, 34 and 35 are idle rollers.

The reverse passage 40 is partitioned from the discharge passage 30 using a paper guide 41, and a reverse roller 42 is disposed on a way from the reverse passage 40 to the intermediate passage 50 in order to push the reversed paper into the intermediate passage 50.

The intermediate passage 50 is formed to be connected with the entrance passage 20 by passing a lower side of the printing body 1 from the way out of the reverse roller 42, and a plurality of conveying rollers 51 are disposed on the intermediate passage 50.

An operation of the conventional paper conveyance guiding apparatus having above structure as follows.

As shown in FIG. 1, the image is printed on the first side of the paper as the paper enters to the printing unit 10 through the entrance passage 20 and is conveyed to the paper conveyance passage 11. As shown in FIGS. 2 and 3, the paper is continuously conveyed along the discharge passage 30 by the first discharging roller 14, which is disposed on the way out of the printing unit 10, and the second discharging roller 31 and the third discharging roller 32 disposed in the discharge passage 30. At this time, the discharging sensor 15 detects a rear end of the paper passing through the settlement unit 13 and entering the discharging passage 30. Here, when the user selects simplex printing to print on the first side of the paper, the paper is discharged to a discharging tray 4 by the third discharging roller 32.

When duplex printing is selected as shown in FIG. 4, the third discharging roller 32 is driven in a reverse direction by a control signal of the controller simultaneously when the rear end of the paper is come out from the paper guide 41, thus the paper is no longer conveyed in the discharging direction. Then, the paper passes through the reverse passage 40 to be engaged with the reverse roller 42 in a state that the first and second sides of the paper are reversed. Accordingly, the paper reenters the printing unit 10 through the intermediate passage 50 and the entrance passage 20 in the state that the first and second sides of the paper are reversed, and the printing is operated on the second side of the paper. The printed paper is discharged to the discharging tray 4 through the discharge passage 30.

However, according to the paper conveyance guiding apparatus of the conventional duplex printer described so far, there should be the separate reverse passage 40 to reverse the paper and the separate reverse roller 42 to allow the reversed paper to enter the intermediate passage 50 and convey the paper to the printing unit 10, thus a structure of the duplex printer is complicated and a production cost is increased as there are a lot of elements required in the duplex printer.

In addition, as a space for installation of the paper guide 41 and the reverse roller 42 to form the separate reverse passage 40 should be secured, it cannot be avoided that an external appearance becomes massive.

Furthermore, the paper conveyance guiding apparatus of the conventional duplex printer has the paper conveying passage 11 to convey the paper through the reverse passage 40 after an end portion of the paper comes out from the paper guide 41 by discharging the paper to the third discharging roller 32 when the paper is reversed for the duplex printing, thus the paper conveying passage becomes longer, and an efficiency of the duplex printing deteriorates.

SUMMARY OF THE INVENTION

The present invention has been made to overcome the above and other problems of the prior art. Accordingly, it is the object of the present invention to provide a paper conveyance guiding apparatus for a duplex printer which enables a discharging and reversing of a sheet of paper on a single conveying passage and also enables a conveyance of the paper in both a discharging direction and a reversing direction with a single reversible rotation roller, thereby achieving a structure simplification through a reduction of parts and also achieving a reduction of a manufacturing cost.

Another object of the present invention is to provide a paper conveyance guiding apparatus for a duplex printer which does not require use of a separate reversing passage and a reversing roller to reverse and convey the paper, and thus contributes to a compactness of the duplex printer.

Yet another object of the present invention is to provide a paper conveyance guiding apparatus for a duplex printer which improves a duplex printing efficiency in reversing the paper due to a shortened paper conveying passage.

Additional objects and advantageous of the invention will be set forth in part in the description which follows and, in part, will be obvious from the description, or may be learned by practice of the invention.

The above and other objects are accomplished by providing a paper conveyance guiding apparatus of a duplex printer according to an embodiment of the present invention. The paper conveyance includes an entrance passage disposed at one side of a printing unit to form a predetermined image on a paper, the entrance passage to guide the paper to enter into the printing unit, a discharge and reverse passage formed to connect a way out of the printing unit with an outside of a printer body and guide discharging of the paper and reversing the paper to a way into the printing unit, an intermediate passage formed to connect the discharge and reverse passage with the entrance passage and guide the reversed paper to reenter into the printing unit through the entrance passage, and a reversible rotation roller disposed at a branching point of the discharge and reverse passage and the intermediate passage to discharge the paper coming out from the printing unit by rotating forwardly and push the paper to the intermediate passage by rotating backwardly.

According to the present invention, the paper is discharged and reversed through one discharge and reverse passage and one reversible rotation roller, thus a structure of the duplex printer is simplified, and a production cost is also reduced as the number of the required elements is decreased.

Moreover, as the paper guide or the reverse roller can be eliminated, an installation space for the elements is reduced, and consequently an external size of the duplex printer is also reduced.

According to an embodiment of the present invention, in the paper conveyance guiding apparatus for duplex printer, the paper on the discharge and reverse passage is reversed into the intermediate passage by a reversal-rotation of the reversible rotation roller in a state that a rear end of the paper is held in the reversible rotation roller.

As the paper on the discharge and reverse passage is reversed in the state that the rear end of the paper is held in the reversible rotation roller, the paper conveying passage is remarkably shortened as compared with a conventional duplex printer, thus a printing efficiency is upgraded when duplex printing is performed.

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
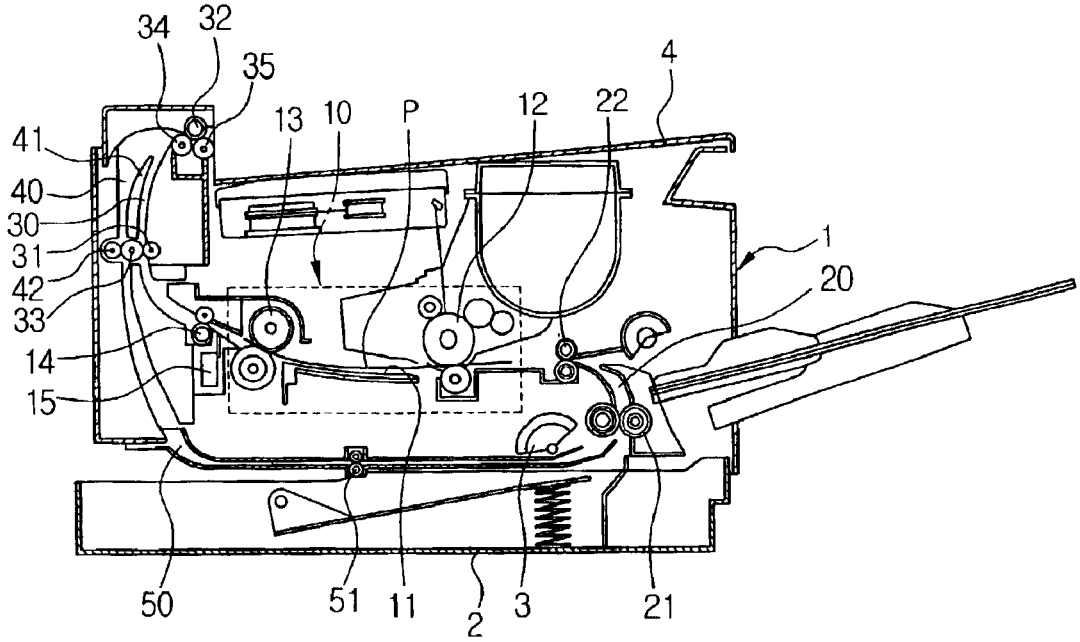
FIG. 1 (PRIOR ART)
FIG. 1 is a partial view schematically showing a duplex printer having a conventional paper conveyance guiding apparatus.
Figure 2:
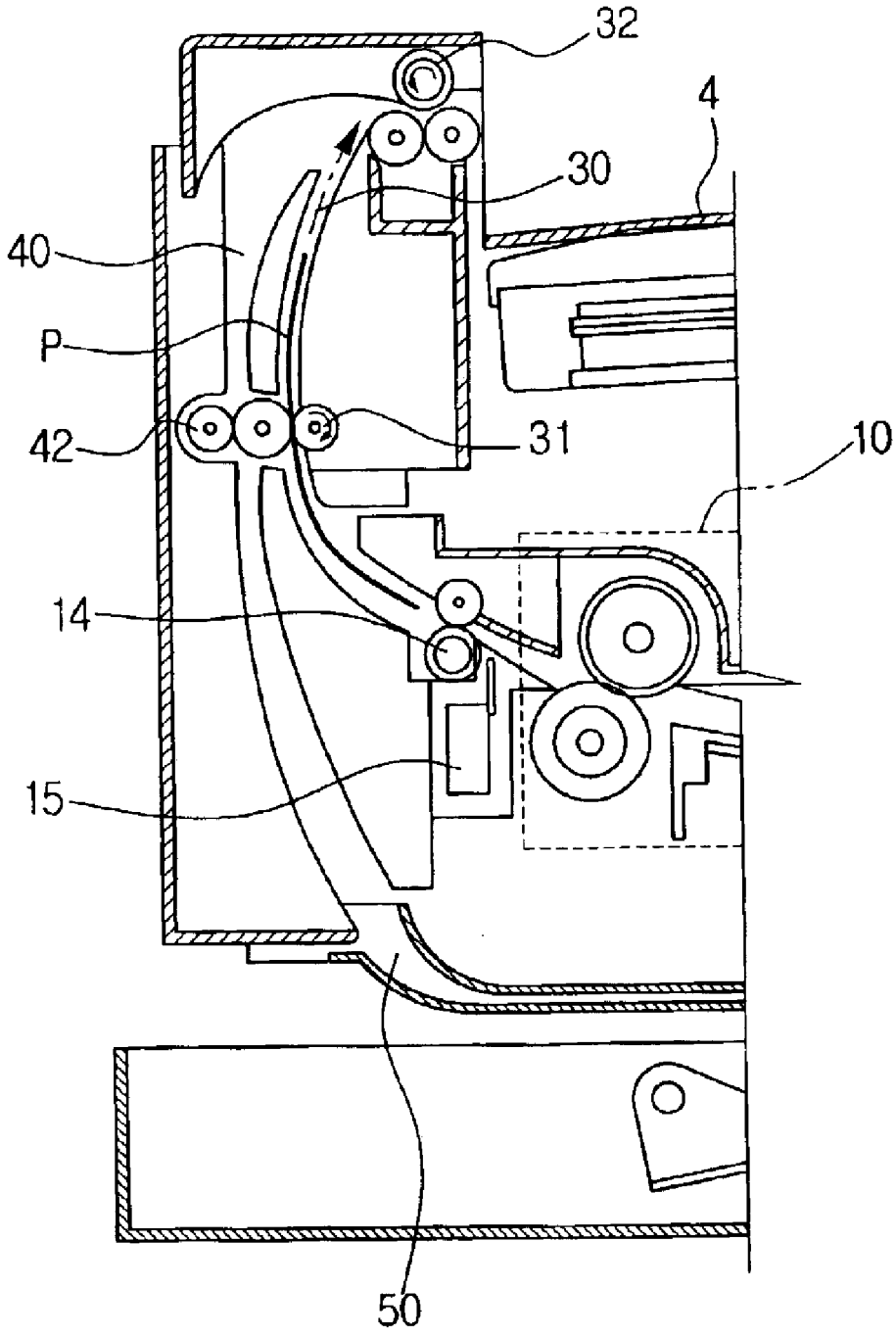
FIG.2 (PRIOR ART)
FIGS. 2 through 4 are partial views showing the operation of the paper conveyance guiding apparatus of a conventional printer shown in FIG. 1.
Figure 3:
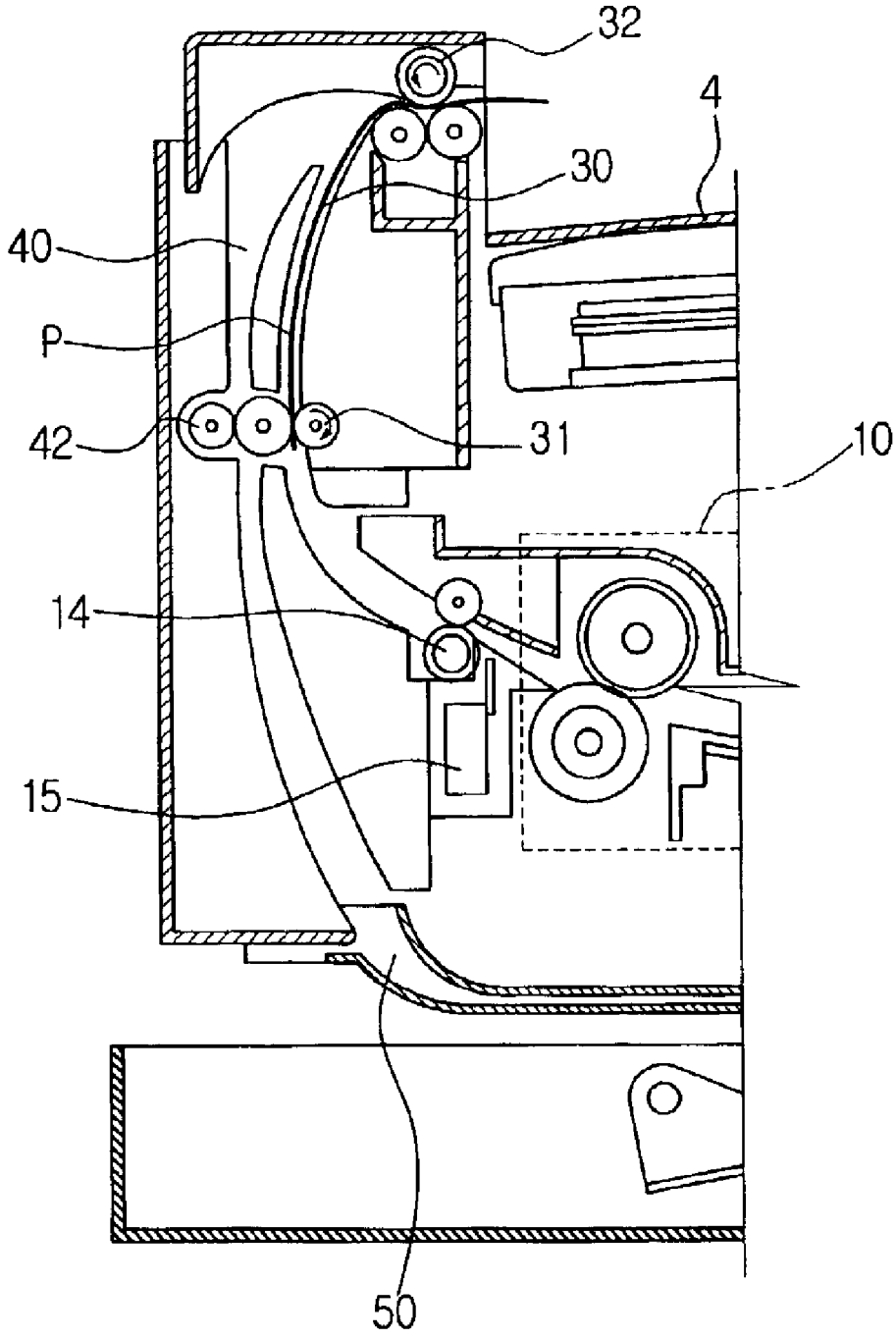
FIG.3 (PRIOR ART)
Figure 4:
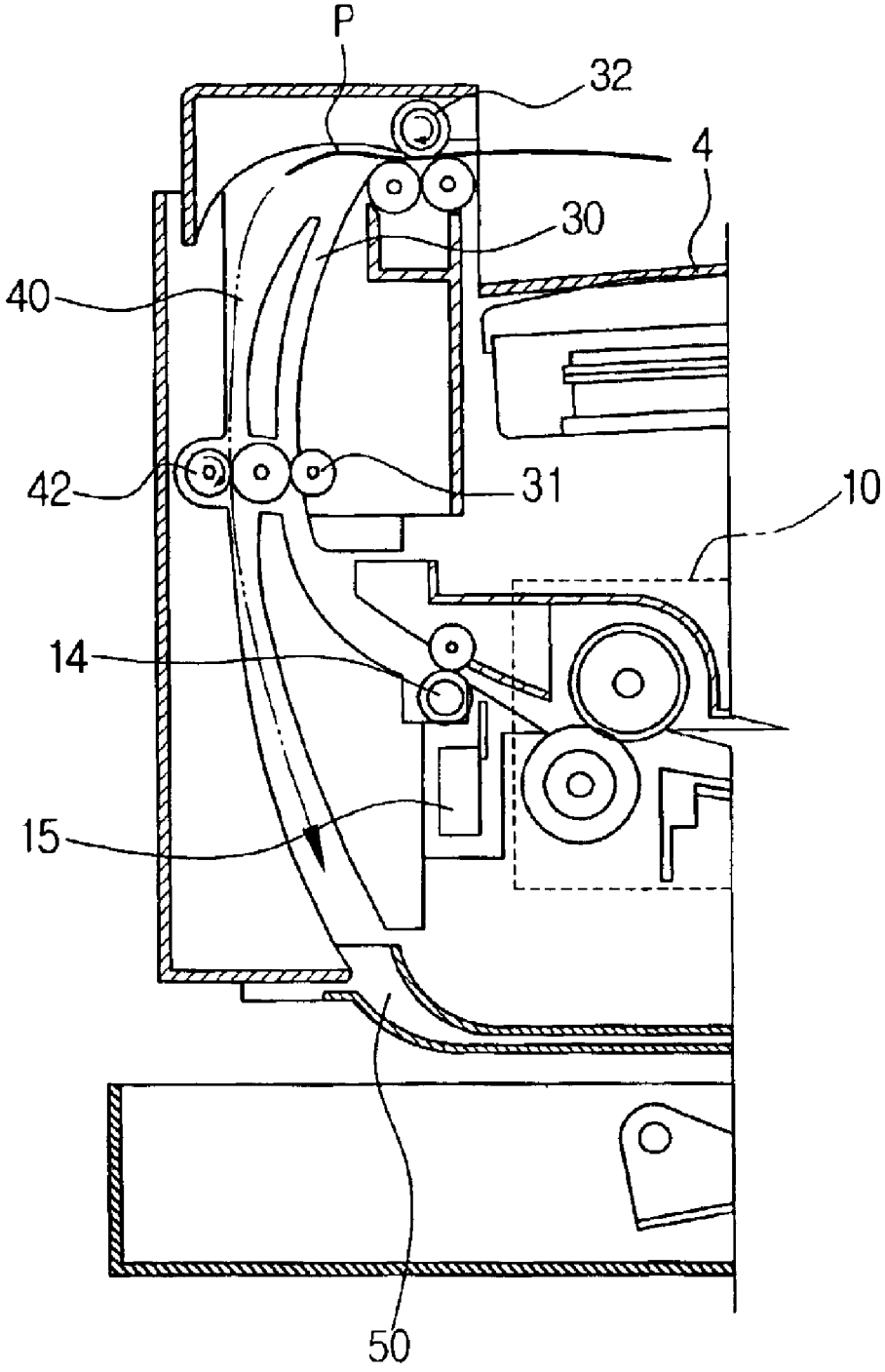
FIG.4 (PRIOR ART)

Reference will now be made in detail to the present preferred embodiment of the present invention, examples of which are illustrated in the accompanying drawings, wherein like reference numerals refer to the like elements throughout. The embodiment is described in order to explain the present invention by referring to the figures.

Hereinbelow, an embodiment according to the present invention will be described in greater detail by referring to the appended drawings. Elements having the same structure and operation as the conventional art of FIGS. 1–4 will be given the same reference numerals in describing the embodiment of the present invention.

As shown in FIGS. 5 through 8, a paper conveyance guiding apparatus of a duplex printer according to an embodiment of the present invention has an entrance passage 20, a single discharge and reverse passage 60, an intermediate passage 50 and a single reversible rotation roller 70.

The entrance passage 20 is disposed at one side of a printing unit 10 forming a predetermined image on a sheet of paper and guides the paper to enter into the printing unit 10. A feed roller 21 and a register roller 22 are disposed at the entrance passage 20 to convey the paper entered into the entrance passage 20 by being picked up by a pick-up roller 3 from a feed cassette 2. The printing unit 10 includes a paper conveying passage 11, a developing unit 12, and a settlement unit 13 disposed in a predetermined interval on the paper conveying passage 11. A first discharging roller 14 is installed at an outlet of the printing unit 10 to convey the printed paper in a discharging direction from the printing unit 10, and a discharging sensor 15 is disposed near the first discharging roller 14 to sense the paper passing through the first discharging roller 14. The discharging sensor 15 sends a sensing signal of sensing the passing of the paper to a controller (not shown).

The discharge and reverse passage 60 is formed to connect the outlet of the printing unit 10 to an outside of a printer body 1. For example, when one side printing (simplex printing) is selected, the discharge and reverse passage 60 guides the discharging of the paper and when duplex printing is selected, the discharge and reverse passage 60 guides the paper to be reversed to an inlet of the printing unit 10. In other words, the paper conveyance guiding apparatus of the duplex printer is structured to selectively perform the discharging and the reversing of the paper through the single discharge and reverse passage 60. Therefore, a structure of the paper conveyance guiding apparatus will be simplified as compared with a conventional paper conveyance guiding apparatus having a conventional reverse passage 40 shown in FIG. 1.

The intermediate passage 50 connects the discharge and reverse passage 60 to the entrance passage 20 and guides the paper reversed at the discharge and reverse passage 60 to reenter into the printing unit 10 through the entrance passage 20. The intermediate passage 50 is formed to reach the entrance passage 20 passing a lower part of the printer body 1 from the discharge and reverse passage 60. A plurality of conveying rollers 51 are disposed at the intermediate passage 50 in a regular interval to convey the paper entered into the intermediate passage 50.

The reversible rotation roller 70 is disposed at a branching point of the discharge and reverse passage 60 and the intermediate passage 50, and the reversible rotation roller 70 can be switched to rotate in one of rotation directions like forward or backward. The reversible rotation roller 70 discharges the paper coming out from the outlet of the printing unit 10 by rotating forwardly to the discharge and reverse passage 60, and the reversible rotation roller 70 pushes the paper to the intermediate passage 50 by rotating backwardly. In other words, in the paper conveyance guiding apparatus of the duplex printer, the single reversible rotation roller 70 conveys the paper by selectively rotating forwardly or backwardly to the discharging direction or a reverse direction. In the conventional paper conveyance apparatus, the discharging roller conveying the paper and the reverse roller reversing the paper are separately disposed in the conventional printer, thus a lot of elements are required and an external appearance is massive due to the number of the elements. However, as described before, the reversible rotation roller 70 is disposed at the discharge and reverse passage 60 to rotate forwardly and backwardly. The reversible rotation roller 70 conveys the paper to the discharging direction or the reverse direction, thus the number of the required elements is reduced, and the installation space for the elements is also reduced. Therefore, the external size of the printer is remarkably reduced.

In the meantime, the present invention is structured to allow the paper to enter the intermediate passage 50 by rotating the reversible rotation roller 70 backwardly, which has been rotating forwardly in a state that a rear end of the paper has not come out completely from the reversible rotation roller 70 end of the paper] but is held in the reversible rotation roller 70. On the contrary, in the conventional duplex printer, the paper conveying passage should be long since the paper should be fully discharged to the third discharging roller from the paper guide in order to allow the paper being discharged through the discharge passage to enter into the reverse passage. However, in the present invention, the paper is reversed in the state that the rear end of the paper is held in the reversible rotation roller 70, so the paper conveying passage can be remarkably shortened as compared with the conventional duplex printer.

Hereinbelow, an operation of the paper conveyance guiding apparatus of the duplex printer according to the present invention having the above structure will be described.

Figure 5:
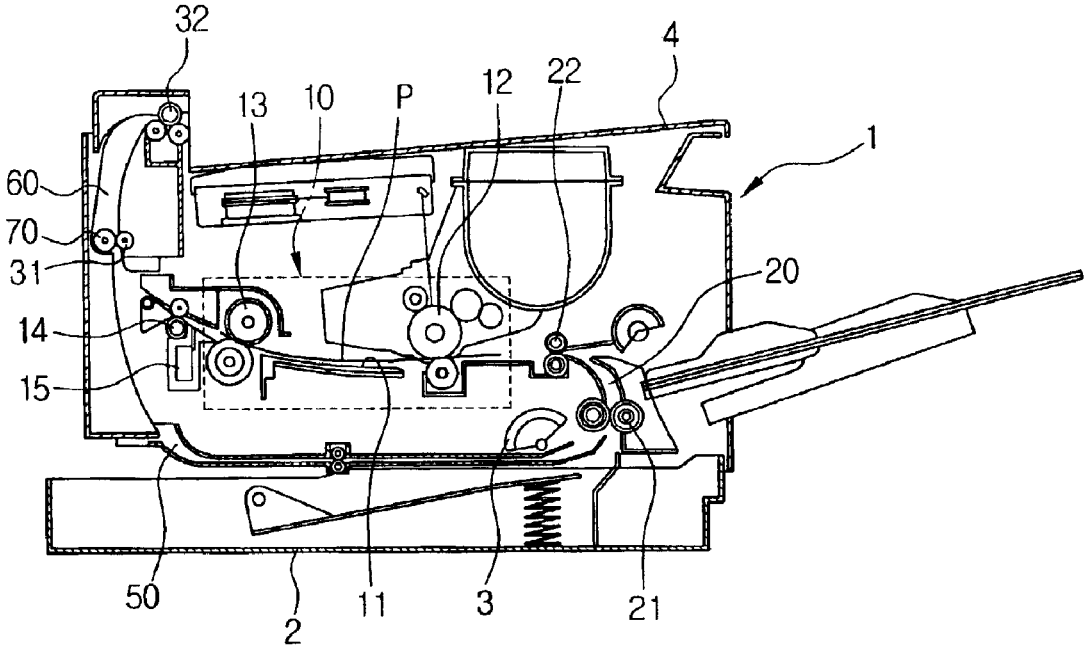
FIG. 5 is a partial view schematically showing a duplex printer having a paper conveyance guiding apparatus according to an embodiment of the present invention.
Figure 6:
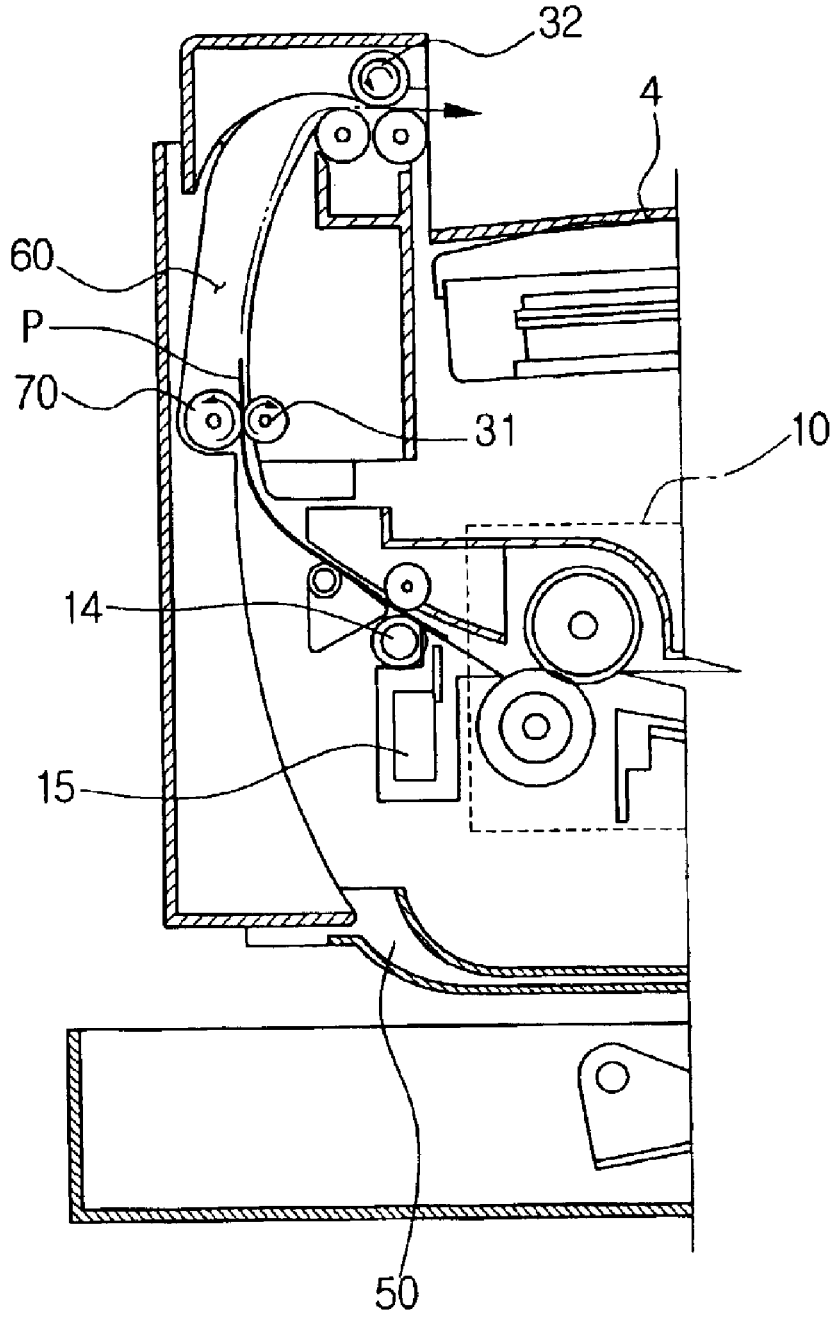
FIGS. 6 through 8 are partial views showing the operation of the paper conveyance guiding apparatus according to the embodiment of the present invention shown in FIG. 5.

As shown in FIG. 5, an image is printed on a first side of the paper as the paper enters into the printing unit 10 through the entrance passage 20 and is conveyed to the printing unit 10. As shown in FIG. 6, the paper having the printed image on the first side and passing through the printing unit 10 is conveyed by the first discharging roller 14 of the outlet of the printing unit 10, and the paper is continuously conveyed along the discharge and reverse passage 60 as a front end of the paper is held in the reversible rotation roller 70 disposed at the discharge and reverse passage 60 and rotating forwardly. At this time, when the rear end of the paper comes out from the first discharging roller 14, the discharging sensor 15 senses the paper coming out from the printing unit 10 and sends the sensing signal to the controller.

The controller controls the reversible rotation roller 70 and the third discharging roller 32 to be rotated forwardly when the one side printing is operated, and the paper is discharged to a discharging tray 4 by the third discharging roller 32.

Figure 7:
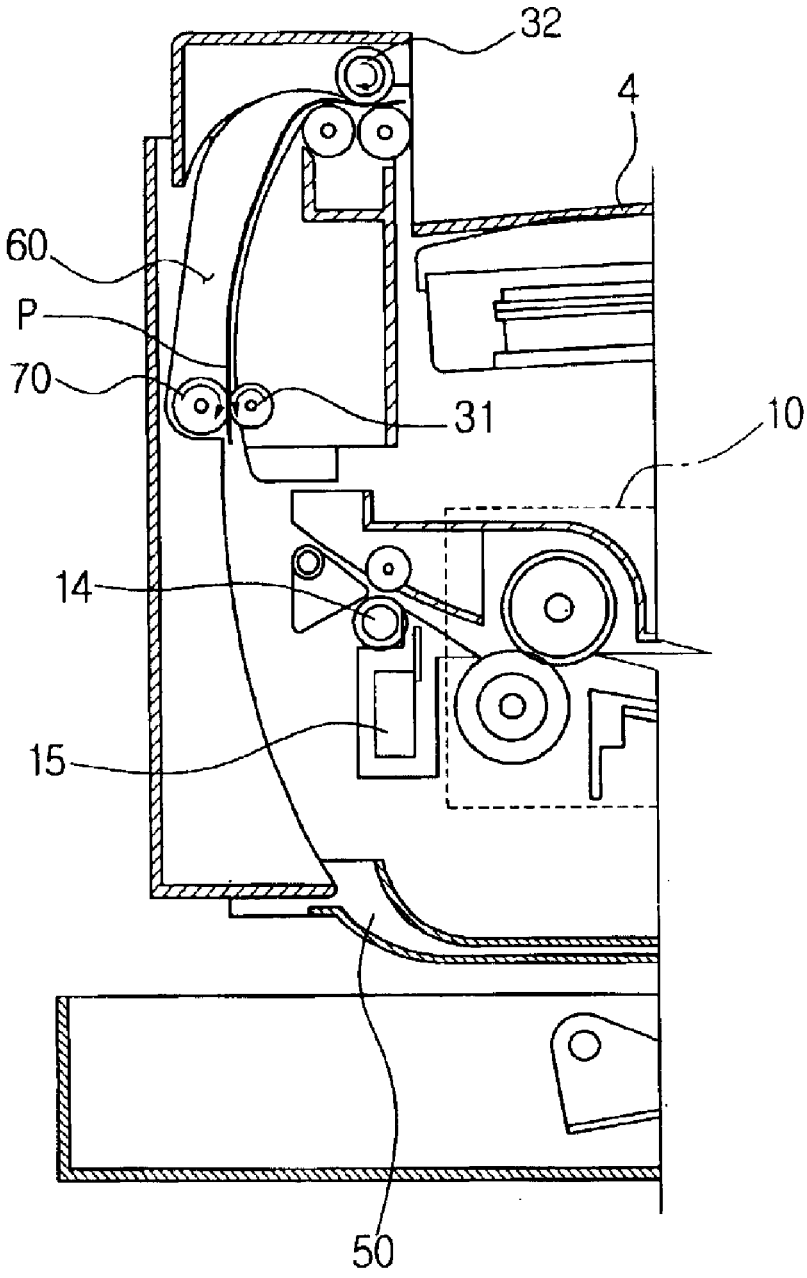
Figure 8:
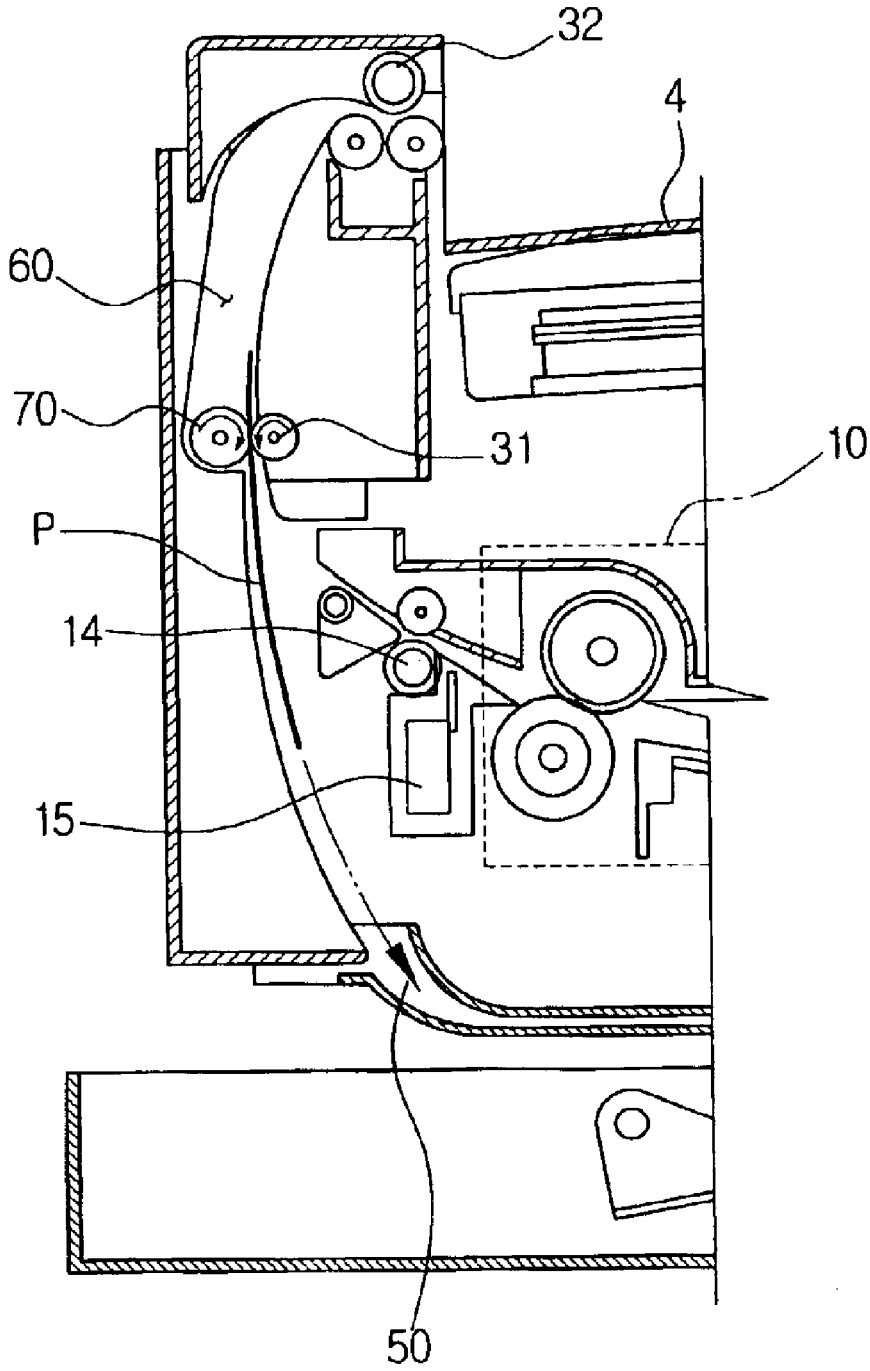

However, when the duplex printing is operated, the controller controls the reversible rotation roller 70 and the third discharging roller 32 to rotate backwardly when it is determined that the paper is conveyed to a position where the rear end of the paper is held in the reversible rotation roller 70 as shown in FIG. 7 by counting a predetermined time when the sensing signal is generated from the discharging sensor 15. The paper having the rear end held in the reversible rotation roller 70 and the front end held in the third discharging roller 32 is entered into the intermediate passage 50 as shown in FIG. 8, by reverse driving of the reversible rotation roller 70 and the third discharging roller 32 in a state that the first and second sides of the paper are reversed with respect to the printing unit 10. In the above process, the third discharging roller 32 reverses its driving direction or stops when the rear end of the paper comes out from the third discharging roller 32, and the reversible rotation roller 70 also reverses its driving direction or stops when the rear end of the paper comes out from the reversible rotation roller 70.

The paper having the first and second sides reversed is entered into the intermediate passage 50 and conveyed to the entrance passage 20 by the driving of the plurality of conveying rollers 51 disposed at the intermediate passage 50. Finally, the paper is held in the feed roller 21 of the entrance passage 20 and reentered into the printing unit 10, and printing another image on the second side of the paper is operated.

The paper having the images printed on both sides by the above process is discharged to the discharging tray 4 through the discharge and reverse passage 60.

As described so far, in the paper conveyance guiding apparatus of the duplex printer according to the present invention, the discharging and the reversing of the paper is operated consecutively due to the reversible rotation roller 70 selectively driven forwardly and backwardly on the discharge and reverse passage 60.

According to the present invention described so far, the paper is discharged and reversed through one discharge and reverse passage and one reversible rotation roller, thus a structure of the duplex printer is simplified and a production cost is also reduced as the number of the required elements decreases.

Moreover, as the paper guide or the reverse roller can be eliminated, an installation space for the elements is reduced and consequently an external size of the duplex printer is also reduced.

In addition, according to the present invention, as the reverse of the paper in the discharge and reverse passage is operated in a state that the rear end of the paper is held in the reversible rotation roller, a paper conveying passage is remarkably shortened as compared with the conventional printer, thus a printing efficiency is upgraded when the duplex printing is operated.

Although an embodiment of the present invention has been described, it will be understood by those skilled in the art that changes may be made in this embodiment without departing from the principles and sprit of the invention, the scope of which is defined in the claims and their equivalents.

What is claimed is:

1. A paper conveyance guiding apparatus in a duplex printer having a printer body and a printing unit, comprising:

an entrance passage disposed at the printing unit forming an image on a sheet of paper to guide the paper to enter into the printing unit;

a discharge and reverse passage formed to connect an outlet of the printing unit with an outside of the printer body and guide discharging of the paper and reversing of the paper to an inlet of the printing unit;

an intermediate passage formed to connect the discharge and reverse passage with the entrance passage and guide the reversed paper to reenter into the printing unit through the entrance passage;

a reversible rotation roller disposed at a branching point of the discharge and reverse passage and the intermediate passage to discharge the paper coming out from the outlet of the printing unit to the outside of the print body by rotating forwardly and push the paper from the discharge and reverse passage to the intermediate passage by rotating backwardly; and a discharging drive roller disposed such that the paper is disposed between the discharging drive roller and the reversible rotation roller at the discharge and reverse passage, the discharging drive roller driving one side of the paper while the reversible rotation roller drives another side of the paper to discharge the paper coming out from the outlet of the printing unit to the outside of the print body.

2. The apparatus of claim 1, wherein the reversible rotation roller reverses the paper to be pushed to the intermediate passage as the reversible rotation roller is rotated backwardly in a state that a rear end of the paper does not come out from the reversible rotation roller but held by the reversible rotation roller when the paper remains in the discharge and reverse passage.

3. A paper conveyance guiding apparatus in a duplex printer having a printing unit printing and fixing an image on a new sheet and a reversed sheet, comprising:

an entrance passage disposed at an inlet of the printing unit to receive one of the new sheet and the reversed sheet and guide the new sheet and the reversed sheet to enter into the inlet of the printing unit;

a discharging drive roller receiving and discharging the printed reversed sheet fed from an outlet of the printing unit to an outside of the duplex printer;

a reversible rotation drive roller disposed between the discharging roller and the outlet of the printing unit to feed the printed reversed sheet toward the discharging roller when rotating in a first direction, and to reverse and feed the printed new sheet toward the inlet of the printing unit through the entrance passage as the reversed sheet by rotating in a second direction when the printed new sheet is held by the reversible rotation roller and the discharging roller; and another discharging drive roller disposed such that the paper is disposed between the another discharging drive roller and the reversible rotation drive roller, the another discharging drive roller driving one side of the paper while the reversible rotation drive roller drives another side of the paper to discharge the paper coming out from the outlet of the printing unit to the discharging drive roller.

4. The apparatus of claim 3, wherein the discharging roller rotates in the same direction as the reversible rotation roller.

5. The apparatus of claim 3, wherein the first and second directions are different from each other.

6. The apparatus of claim 3, wherein the printing unit comprises a settling unit having a settling roller fixing the image on the new sheet and the reversed sheet, and the reversible rotation roller is disposed adjacent to the settling roller to receive the printed new sheet and the printed reversed sheet from the settling roller.

7. The apparatus of claim 3, wherein the apparatus comprises an intermediate passage formed between the reversible rotation roller and the entrance passage, and the reversible rotation roller is disposed at a junction of the outlet of the printing unit and an inlet portion of the intermediate passage.

8. The apparatus of claim 7, wherein apparatus comprises a common space formed among the reversible rotation roller, the outlet of the printing unit, and the inlet portion of the intermediate passage, and the reversible rotation roller holds the printed new sheet having a rear end disposed in the common space.

9. The apparatus of claim 8, wherein the reversible rotation roller changes a rotation direction from the first direction to the second direction.

10. The apparatus of claim 3, wherein the apparatus comprises a discharging sensor detecting a rear end of the printed new sheet leaving from the outlet of the printing unit to the reversible rotation roller, and the reversible rotation roller changes a rotation direction from the first direction to the second direction a predetermined time after the discharging sensor detects the rear end of the printed new sheet leaving from the outlet of the printing unit.

11. The apparatus of claim 10, wherein the reversible rotation roller rotates in the first direction before the discharging sensor detects the rear end of the printed new sheet leaving from the outlet of the printing unit.

12. The apparatus of claim 11, wherein the discharging roller rotates in the first direction before the discharging sensor detects the rear end of the printed new sheet leaving from the outlet of the printing unit.

13. The apparatus of claim 11, wherein the discharging roller rotates in the second direction the predetermined time after the discharging sensor detects the rear end of the printed new sheet leaving from the outlet of the printing unit.

14. The apparatus of claim 3, wherein the apparatus comprises a single discharge and reverse common passage formed between the reversible rotation roller and the discharge roller to receive the printed new sheet and the printed reversed sheet.

15. The apparatus of claim 14, wherein the printed reversed sheet is discharged through the single discharge and reverse common passage.

16. The apparatus of claim 14, wherein the single discharge and reverse common passage reverses and feeds the printed new sheet toward the inlet of the printing unit when the printed new sheet is disposed in the single discharge and reverse common passage.

17. The apparatus of claim 14, wherein the single discharge and reverse common passage is disposed at the outlet of the printing unit to receive the printed new sheet and the printed returned sheet from the outlet of the printing unit and guide the printed reversed sheet to be discharged outside the duplex printer and the printed new sheet to be reversed and fed toward the entrance passage as the reversed sheet.

18. The apparatus of claim 14, wherein the single discharge and reverse common passage does not contain an element blocking a discharging direction of the printed reversed sheet and a reversing direction of the printed new sheet.

19. The apparatus of claim 14, the apparatus comprises: an intermediate passage disposed between the single discharge and reverse common passage and the entrance passage to guide the reversed sheet to be fed to the inlet of the printing unit through the entrance passage.

20. The apparatus of claim 3, wherein the duplex printer comprises a paper cassette containing the new sheet, and the entrance passage guides the new sheet received from paper cassette and the reversed sheet received from the reversible rotation roller to be fed toward the inlet of the printing unit.

21. The apparatus of claim 3, wherein a rotation direction of the reversible rotation roller and the discharge roller is changed from the first direction to the second direction when a rear end of the printed new sheet and a front end of the printed new sheet are disposed on the reversible rotation roller and the discharge roller, respectively.

22. A paper conveyance guiding apparatus in a duplex printer having a printer body and a printing unit, comprising:

an entrance passage disposed at the printing unit forming an image on a sheet of paper to guide the paper to enter into the printing unit;

a discharge and reverse passage formed to connect an outlet of the printing unit with an outside of the printer body and guide discharging of the paper and reversing of the paper to an inlet of the printing unit;

an intermediate passage formed to connect the discharge and reverse passage with the entrance passage and guide the reversed paper to reenter into the printing unit through the entrance passage; and a reversible rotation roller disposed at a branching point of the discharge and reverse passage and the intermediate passage to discharge the paper coming out from the outlet of the printing unit to the outside of the print body by rotating forwardly and push the paper from the discharge and reverse passage to the intermediate passage by rotating backwardly; and a discharging drive roller disposed such that the paper is disposed between the discharging drive roller and the reversible rotation roller at the discharge and reverse passage, the discharging drive roller driving one side of the paper while the reversible rotation roller drives another side of the paper to discharge the paper coming out from the outlet of the printing unit to the outside of the print body, wherein the reversible rotation roller reverses the paper to be pushed to the intermediate passage as the reversible rotation roller is rotated backwardly in a state that a rear end of the paper does not come out from the reversible rotation roller but held by the reversible rotation roller when the paper remains in the discharge and reverse passage and reversible rotation roller rotating forward and backward in the same location.

* * * * *